United States Patent [19]

Kumamoto et al.

[11] Patent Number: 4,773,774

[45] Date of Patent: Sep. 27, 1988

[54] PRINTER WITH ERASING RIBBON CONTROL FUNCTION

[75] Inventors: Michihisa Kumamoto, Tokyo; Hiroyuki Ueda, Kanagawa, both of Japan

[73] Assignee: Canon Kabushiki Kaisha, Tokyo, Japan

[21] Appl. No.: 33,880

[22] Filed: Apr. 2, 1987

Related U.S. Application Data

[63] Continuation of Ser. No. 773,104, Sep. 6, 1985, abandoned, which is a continuation of Ser. No. 537,576, Sep. 30, 1983, abandoned.

[30] Foreign Application Priority Data

Oct. 29, 1982 [JP] Japan ..... 57-191078

[51] Int. Cl.[4] ..... B41J 29/26

[52] U.S. Cl. ..... 400/697.1; 400/17; 400/227; 400/231; 400/301

[58] Field of Search ..... 400/16, 17, 22, 216, 400/227, 231, 233, 300, 301, 302, 304, 696, 697, 697.1, 695

[56] References Cited

U.S. PATENT DOCUMENTS

| | | | |
|---|---|---|---|
| 1,462,886 | 7/1923 | Hulse | 400/300 |
| 1,463,778 | 7/1923 | Hulse | 400/300 |
| 4,157,224 | 6/1979 | Purzycki et al. | 400/233 |
| 4,392,758 | 7/1983 | Bowles et al. | 400/697.1 |
| 4,397,575 | 8/1983 | Aldrich | 400/697.1 |
| 4,453,167 | 6/1984 | Motoyoshi | 400/697 |
| 4,728,209 | 3/1988 | Kumamoto et al. | 400/697.1 |

FOREIGN PATENT DOCUMENTS

| | | | |
|---|---|---|---|
| 55-137985 | 10/1981 | Japan | 400/697 |

*Primary Examiner*—David A. Wiecking

*Attorney, Agent, or Firm*—Fitzpatrick, Cella, Harper & Scinto

[57] ABSTRACT

Disclosed is a printer having a correction ribbon tape for correcting printed characters. A plurality of characters printed in the same print position can be corrected in one step of feed of the correction ribbon tape.

14 Claims, 4 Drawing Sheets

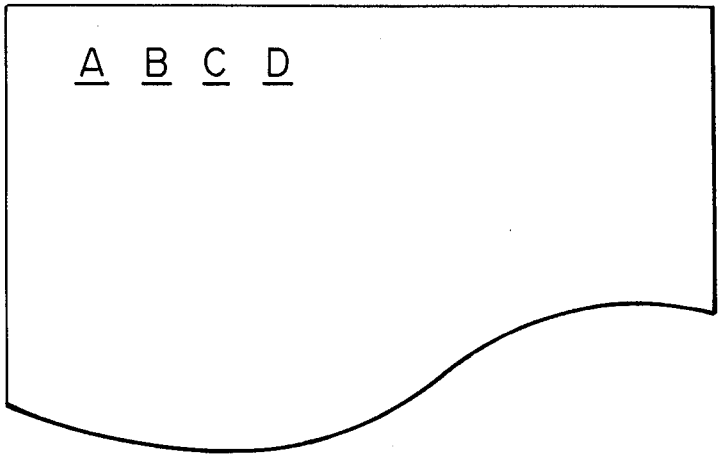
FIG. 1
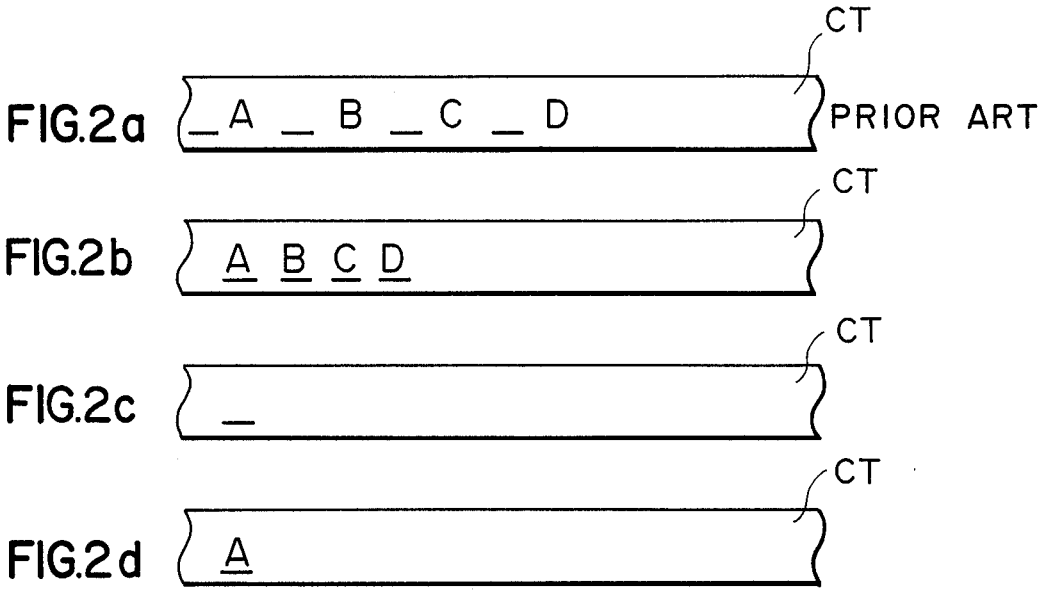

PRINTER WITH ERASING RIBBON CONTROL FUNCTION

This application is a continuation of application Ser. No. 773,104, filed 9-6-85, now abandoned, which is a continuation of Ser. No. 537,576, filed 9-30-83, now abandoned.

BACKGROUND OF THE INVENTION

1. Field of the Invention

The present invention relates to a printer, and more particularly to a printer which has a correctable ink ribbon and a correction ribbon tape known in an electronic typewriter and can automatically or manually correct printed characters.

2. Description of the Prior Art

In a prior art printer such as an electronic typewriter, when a plurality of characters printed in the same print position such as a character with an underline as shown in FIG. 1 is to be erased, a new portion of a correction ribbon tape CT is fed each time one of the characters has been erased, as shown in FIG. 2(*a*). As a result, the consumption of the correction ribbon tape is large and a time to feed the correction ribbon tape is required each time when one character has been erased.

SUMMARY OF THE INVENTION

It is an object of the present invention to provide a printer in which the correction operation is repeated with only one step of feed of the correction ribbon tape as shown in FIG. 2(*b*) when a plurality of characters printed in the same print position is to be corrected so that the correction ribbon tape is saved and the time to make corrections is shortened.

BRIEF DESCRIPTION OF THE DRAWINGS

FIG. 1 illustrates a printout on a paper,

FIG. 2 shows correction tapes after correction, in which FIG. 2(*a*) shows a tape in accordance with a prior art method and FIGS. 2(*b*), 2(*c*) and 2(*d*) show tapes in accordance with the present invention.

DETAILED DESCRIPTION OF THE PREFERRED EMBODIMENT

Figure 3:
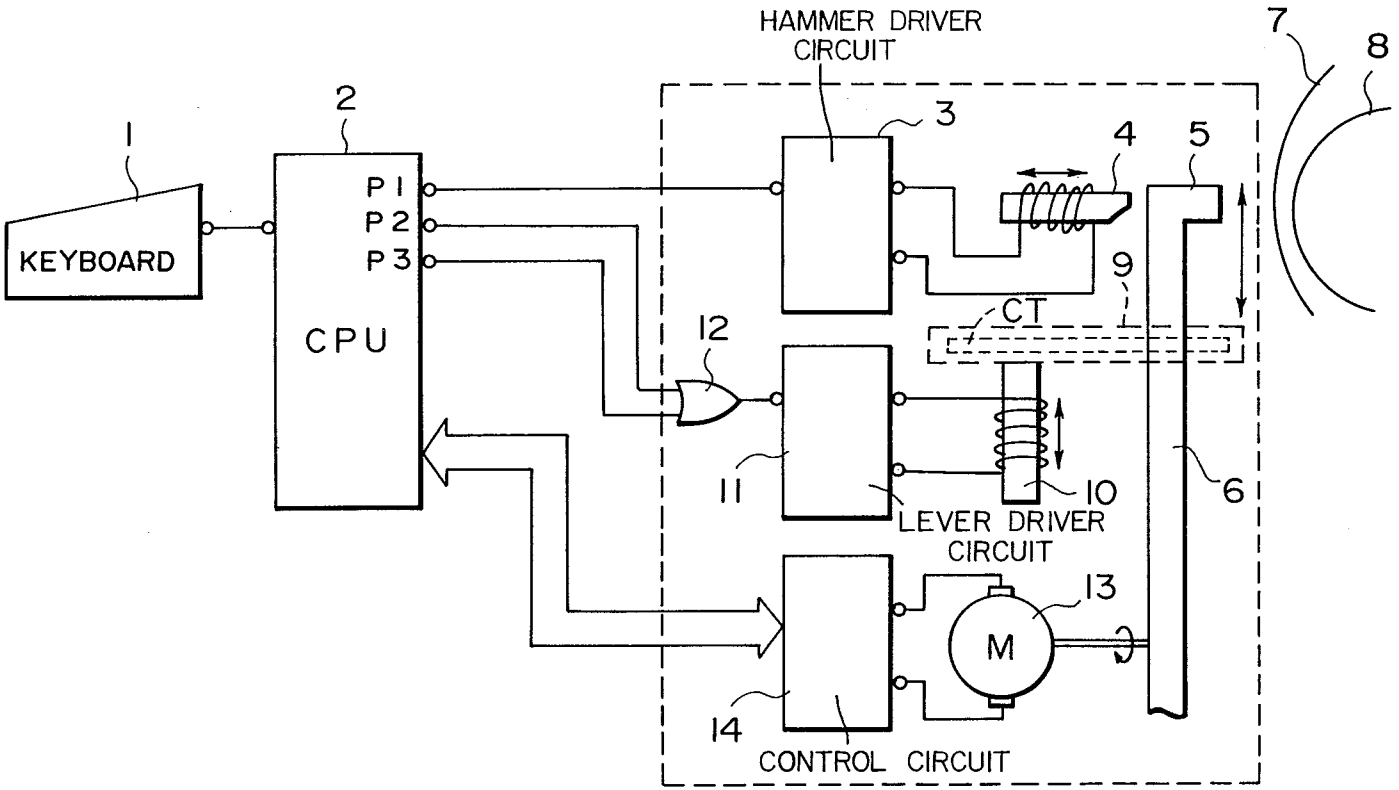
FIG. 3 shows a block diagram of one embodiment of the present invention.

FIG. 3 shows an embodiment of the present invention, in which numeral 1 denotes a keyboard, numeral 2 denotes a central processing unit (CPU), numeral 3 denotes a hammer driver, numeral 4 denotes a print hammer, numeral 5 denotes types, numeral 6 denotes a type wheel bearing the types 5, numeral 7 denotes a print paper, numeral 8 denotes a platen, numeral 9 denotes a cassette which contains a correction ribbon tape, and numeral 10 denotes a lever for moving the cassette 9 up and down. When the cassette 9 is moved up, the correction ribbon tape is fed. Numeral 11 denotes a drive circuit for the lever 10, numeral 12 denotes an OR circuit, numeral 13 denotes a motor for rotating the type wheel 6 and numeral 14 denotes a control circuit for the type wheel motor 13.

Figure 4:
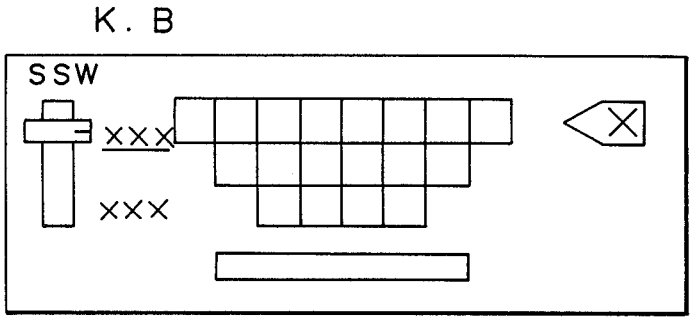
FIG. 4 shows a keyboard.

FIG. 4 shows a keyboard, in which SSW denotes a slide switch which selects a normal print mode when it is in a position XXX and selects an underlined print mode when it is in a position XXX, ⟨X⟩ denotes a correction start key, and other keys are character keys.

The manual erasure of the printed character with underline "A" shown in FIG. 1 is now explained. An operator first sets the switch SSW to the position XXX and depresses the correction key ⟨X⟩. Thus, a correction start code is transferred from the keyboard 1 to the CPU 2. When the CPU 2 receives the correction start code, it renders the output port P3 to logic "1". Thus, the OR circuit 12 produces a "1" output and the driver 11 for the lever 10 drives the lever 10 to lift the correction ribbon tape cassette 9. As a result, the correction ribbon tape is fed one step. Then, the operator depresses the key "A" corresponding to the printed character. Thus, the underline code and the character code are transferred from the keyboard 1 to the CPU 2. In response to the underline code, the CPU 2 renders the output port P2 to "1". Then, it sends a signal to select the underline type to the type wheel motor control circuit 14 so that the circuit 14 selects the underline type. When an end of type selection signal is sent from the type wheel motor control circuit 14 to the CPU 2, the CPU 2 sends a print command signal P1 to the print hammer drive circuit 3. As a result, the print hammer drive circuit 3 drives the print hammer 4 so that the underline indicia is pressed against the correction tape CT as shown in FIG. 2(*c*) and the underline is erased. At the end of the energization of the print hammer 4, the CPU 2 renders the port P2 to "0", but since the port P3 is "1" and the correction ribbon tape cassette 9 remains at the up position, the correction ribbon tape is not fed. When the CPU 2 receives the character code, it renders the port P2 to "1" and the port P3 to "0". Since the output of the OR circuit 12 is "1" at this time, the correction ribbon tape cassette remains at the up position. The CPU 2 sends a signal requesting selection of the type "A" to the type wheel motor control circuit 14 and the character "A" is erased as shown in FIG. 2(*d*) by the print command signal P1 in the same manner as described above. When the print hammer 4 is deenergized, the CPU 2 renders the port P2 "0". Since both ports P2 and P3 are now "0", the output of the OR circuit 12 changes to "0" and the correction ribbon cassette 9 is shifted down.

Figure 5:
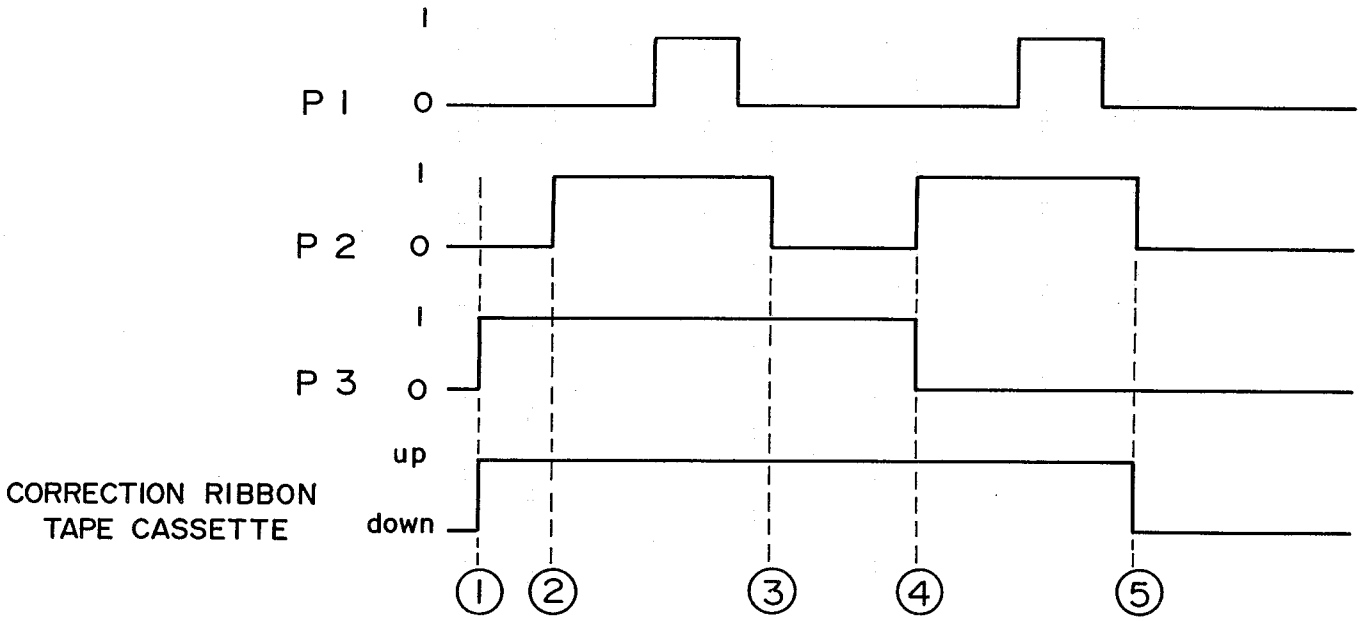
FIG. 5 shows a time chart for ports P1, P2 and P3 shown in FIG. 3 and a correction ribbon cassette.

FIG. 5 shows levels of the ports P1, P2 and P3 and the correction ribbon cassette 9. ① indicates the reception of the correction start code by the CPU 2, ② and ④ indicate the reception of the underline code and the character code, ③ and ⑤ indicate the end of one character erasure.

As described herein above, in accordance with the present invention, when a plurality of characters are printed at the same print position, such as a character with underline, or a " ʸ " character which is composed by "Y" and "=", the correction operation is carried out a plurality of times without feeding the correction ribbon tape so that the correction ribbon tape is saved and the correction time is shortened. While the manual erasure operation has been described above, the printed characters can be automatically erased by storing the printed characters in a memory such as a RAM and issuing a correction start signal.

What we claim is:

1. A printer with an erasing function comprising:

a correction ribbon;

pressing means for pressing at least part of said correction ribbon onto a printed character to effect erasure thereof;

feeding means for feeding said correction ribbon;

mode setting means for setting a complex character printing mode;

type selecting means for selecting from a type unit different types that correspond to a plurality of indicia in the complex character to be printed;

erasure instructing means for instructing erasure of the printed character;

activating means for activating said pressing means a plurality of times to press said correction ribbon onto a complex printed character using the types selected by said type selecting means to effect erasure of the printed complex character;

control means, responsive to a single key input when said mode setting means has set said complex character printing model and said erasure instructing means has instructed erasure , for controlling said activating means, and for controlling a disabling of said feeding means to effect erasure without moving said correction ribbon between plural activations of said pressing means during the erasing operation.

2. A printer with an erasing function according to claim 1, wherein said correction ribbon is accommodated in a cassette and fed in response to a signal that moves said cassette into a position for the erasing operation.

3. A printer with an erasing function according to claim 1, wherein the plurality of indicia include an information for modifying the type.

4. A printer with an erasing function according to claim 1, wherein the plurality of indicia include an additional character printed in the same print position as the type.

5. A printer with an erasing function according to claim 1, wherein the erasing function can be performed in a sequence similar to the printing sequence of the plurality of indicia in the complex character.

6. A printer with an erasure function according to claim 1, wherein said printed complex character consists of a letter and an underline added to said letter.

7. A printer with an erasing function, comprising:

(a) a keyboard including;

a first key means for providing a desired character code, second key means for providing an instruction to erase a printed character, and mode setting means for setting an underline mode in which, when a character code is input,an underline is automatically added to the character in response to the input character code and the character with the underline is printed to produce a complex character, (b) a printing unit including:

printing means for printing the desired character in response to the desired character code provided by said first key means, erasing means responsive to said second key means including a feedable erasure ribbon for performing an erasure operation to erase the character printed by said printing means, and feeding means for feeding the erasure ribbon, (c) controlling means, responsive to the second key means and to the first key means when the underline mode has been set and the complex character has been printed, for causing said feeding means to feed the erasure ribbon in response to the erasure instruction through said second key means and then inputting to said printing unit one character code which represents the character constituting said complex character, said controlling means also for preventing the feeding means from feeding the erasure ribbon between the erasure operation of said character and the erasure operation of said underline character such that the complex character corresponding to said character code and the underline character on the same print position are erased without additional feeding of the erasure ribbon.

8. A printer with an erasing function according to claim 7, wherein said printing means uses a hammer means for impacting a type element with a ribbon to print a type and said erasing means uses said hammer means for impacting a type element with the erasure ribbon to erase the type.

9. A printer with an erasing function according to claim 8, further comprising ribbon movement means for moving the erasure ribbon to an erasure impact position in response to the instruction provided by said second key means.

10. A printer with an erasing function according to claim 8 or 9 wherein said controlling means includes said feeding means for feeding the ribbon in response to the instruction provided by said second key means.

11. A printer with an erasing function according to claim 9, wherein in the case said mode is set by said mode setting means, said controlling means includes means for generating in response to the output of said first key means a code corresponding to the desired type information and a code corresponding to the additional information such as underline information.

12. A printer with an erasing function according to claim 11, wherein the erasure ribbon is in the erasure impact position when one of said type information code and said underline code is generated by said controlling means.

13. A printer with an erasure function for erasing an underline and a character both printed at the same print position, comprising:

a keyboard which includes various keys, further comprising:

an input unit for providing a desired character code;

mode setting means for setting an underline mode in which, when a character code is input, an underline is automatically added to the character in response to the input character code and the character with the underline is printed so as to produce a complex character;

printing means for printing a desired character or underline in response to the character code or underline code provided thereto, said printing means further comprising:

a type wheel which comprises a plurality of types including an underline type, a wheel motor which rotates said type wheel to select one of said plurality of types, first drive means for driving said wheel motor, pressing means for pressing the type of said type wheel on a recording medium on a platen through a ribbon to print or a correction ribbon to erase, second drive means for driving said pressing means, and ribbon moving means for moving said correction ribbon to an up position to be pressed with one of the types by said pressing means and for feeding said ribbon and correction ribbon, memory means for storing therein the character code provided by said input unit;

erasure instruction means, responsive to operation of one of said keys when said underline mode is set by said mode setting means, for providing an erasure instruction to instruct erasure of the underline and character which are printed by said printing means;

transfer means, responsive to the instruction from said erasure instruction means, for transferring the underline code and the character code from said memory means to said first drive means; and control means for preventing said ribbon moving means from feeding said correction ribbon until the transfer operation of said transfer means is completed and said pressing means has pressed the correction ribbon to the recording medium once to erase the character and once to erase the underline while the up position of said correction ribbon is maintained by the ribbon moving means after setting said underline mode and printing the complex character, by setting the same mode as said underline mode in said printing operation and operating said erasure instruction means.

14. A printer with an erasing function according to claim 13, wherein said ribbon moving means feeds the correction ribbon by one step before erasure of indicia at one character position.

* * * * *

UNITED STATES PATENT AND TRADEMARK OFFICE

CERTIFICATE OF CORRECTION

PATENT NO. : 4,773,774

DATED : September 27, 1988

INVENTOR(S) : Kumamoto, et al.

It is certified that error appears in the above-identified patent and that said Letters Patent is hereby corrected as shown below:

COLUMN 2

Line 51, "herein above" should read --hereinabove--.

Line 54, "Y" should read --¥--.

COLUMN 3

Line 16, "model" should read --mode--;

Line 39, "erasure" should read --erasing--.

COLUMN 4

Line 24, "claim 8 or 9" should read --claim 8 or 9,--.

Signed and Sealed this

Twenty-fifth Day of April, 1989

*Attest:*

DONALD J. QUIGG

*Attesting Officer*

*Commissioner of Patents and Trademarks*